US005287575A

United States Patent [19]

Allen et al.

[11] Patent Number: 5,287,575

[45] Date of Patent: Feb. 22, 1994

[54] HAND TABLE

[75] Inventors: R. Daniel Allen, Newbury; Yury Keselman, Woodmere Village, both of Ohio

[73] Assignee: Allen Medical Systems, Bedford Hts., Ohio

[21] Appl. No.: 973,407

[22] Filed: Nov. 9, 1992

[51] Int. Cl.[5] ..... A61G 13/00

[52] U.S. Cl. ..... 5/623; 5/507.1; 248/231.2; 248/231.4

[58] Field of Search ..... 128/877, 878, 879; 5/507.1, 621, 623, 646; 108/49, 97; 248/231.2, 231.4

[56] References Cited

U.S. PATENT DOCUMENTS

| | | | |
|---|---|---|---|
| 1,797,847 | 3/1931 | Vandagriff | 5/507.1 X |
| 1,862,237 | 6/1932 | Pepler | 5/507.1 X |
| 2,073,932 | 3/1937 | Hawley . | |
| 2,605,152 | 7/1952 | Krewson | 5/623 X |
| 2,642,250 | 6/1953 | Kasnowich | 108/49 X |
| 2,972,505 | 2/1961 | Weickgenannt | 5/646 |
| 3,086,226 | 4/1963 | Kyser et al. | 5/507.1 |
| 4,045,011 | 8/1977 | Ford | 5/623 X |
| 4,054,282 | 10/1977 | Hamer | 5/623 X |
| 4,616,813 | 10/1986 | McConnell . | |
| 4,635,914 | 1/1987 | Kabanek . | |
| 4,653,482 | 3/1987 | Kurland . | |
| 4,702,465 | 10/1987 | McConnell | 5/646 |
| 4,858,903 | 8/1989 | Tari et al. | 5/623 |

*Primary Examiner*—Michael F. Trettel

*Attorney, Agent, or Firm*—Pearne, Gordon, McCoy & Granger

[57] ABSTRACT

The present invention is directed towards an auxiliary hand table which is removably mounted to a main surgical table. The hand table is mounted, via first and second mounting devices, to the rails provided on each side of the main surgical table. The first mounting device includes upper and lower jaws, the upper jaw being provided with a fastener to positively attach the device to the rail. The second mounting device includes a pair of interconnected hook-shaped members which are hooked over the opposite rail. The second mounting device further includes a series of mounting studs which facilitate attachment of a hand table support structure, thereby supporting the hand table. The vertical position of the hand table relative to the main table is adjusted by altering the mounting position of the support structure to the second mounting device. A tensioning bar interconnects the mounting devices, one end of the bar being received by an elongated bore provided by the first mounting device. Adjustment of the tension between the devices is accomplished via a tensioning device which is threadably mounted to the first mounting device and engages an end of the tensioning bar. As the tension between the first and second mounting devices reaches the desired amount for correct mounting of the hand table, the terminal end of the hand table moves slightly upward relative to the main table, providing visual indication that the hand table is properly mounted.

17 Claims, 4 Drawing Sheets

HAND TABLE

BACKGROUND OF THE INVENTION

1. Field of the Invention

The present invention generally relates to surgical tables and, more particularly, to auxiliary arm or hand tables which are removably mounted to a main surgical table.

2. Description of Related Art

Over the years, hand tables have been developed to aid surgeons in supporting and positioning a patient's arm during a medical procedure thereon. The resulting hand tables have generally tended to be either an independent table or a table which is removably mounted to the main surgical table. The hand tables which are removably mounted to the main table have evolved into two general types: a first type which uses a separate supporting structure to maintain the table in position relative to the main table and a second type which has an integral support structure extending between the main table and the hand table.

U.S. Pat. No. 4,653,482, which is incorporated herein by reference, is illustrative of the first type of removably mounted hand tables. The table disclosed therein is provided with rail engaging means to attach the hand table to the main surgical table and with a main support leg or post. The support post bears a substantial portion of the tables weight and thereby maintains the hand table in a generally constant position relative to the main table. U.S. Pat. No. 4,653,914, which is also incorporated herein by reference, discloses a similar arrangement wherein the hand table is mounted to the rail by means of clamps which provide a slot to receive a projection carried by the table.

The second type of removably mounted hand table is vertically supported by means which engage the main surgical table, eliminating the necessity of an extra support leg. In hand tables of this sort, one end of hand table is releasably attached to the rail provided by the main surgical table and the support means extends from the main table to the hand table at a location removed from the main table. U.S. Pat. Nos. 2,073,932 and 4,045,011, each of which are incorporated herein by reference, are representative of the second type of hand surgical tables.

The hand surgical tables thusfar described suffer from inherent disadvantages which limit their desirability to the medical profession. In removably mounted tables of the first type, although the support leg helps to provide a stable platform for the surgeon, it also represents an unnecessary obstacle or hazard to the surgeon and associated surgical staff during performance of the surgery. Also, tables of this type tend to be rather bulky and ungainly during setup and removal, further lessening their desirability.

The removably mounted tables of the second type tend to be rather flimsy and unstable during use due to the lack of a solid support system, and have a tendency to wobble on the rail due, in part, to the manner in which they are attached to the main table. Moreover, the support tends to be rather elastic, resulting in an unwanted "springboard" effect is rather awkward and undesirable during surgery.

Additionally, hand tables of both types tend to lack the ability to vertically adjust the position of the hand table relative to the main table while maintaining the hand table in a generally horizontal attitude. Finally, such devices do not include visual feedback that the hand table is properly mounted on the main table.

Therefore, there exists a need in the art for a hand table which provides a stable surface without requiring extra ground engaging support legs. There also exists a need for a hand table which is easily vertically adjustable relative to the main table while being maintained in a generally horizontal position relative to the supporting surface. Finally, there exists a need for a hand table which provides some visual indication when properly mounted on the main surgical table.

SUMMARY OF THE INVENTION

The present invention is directed towards a hand table which is removably mounted to a main surgical table and provides a stable, vertically adjustable surface. In accordance with the present invention, the hand table is removably mounted to the main surgical table by mounting means which engage the rails conventionally provided on opposite sides of the main surgical table.

In further accordance with the present invention, the first mounting means is attached to one rail by means of a clamping device while the second mounting means includes a pair of hook-shaped members which provide downwardly opening channels which snugly fit over the second rail.

The second mounting means also attaches to a hand table support means which is formed integrally with, and extends downwardly from, the hand table. The attachment of the second mounting means and the support means includes a vertical height adjustment means whereby the vertical position of the hand table relative to the main surgical table may be adjusted.

The first mounting means provides an elongated bore for the telescoping receipt of a tensioning bar. The tensioning bar is generally Y-shaped and extends between the first and second mounting means, the leg of the tensioning bar being received by the elongated bore of first mounting means while the arms thereof are attached to the second mounting means.

The first mounting means also provides, at the lower extremity thereof, a force or tension adjustment means. The tension adjustment means includes a threadably mounted rod, the terminal end of which engages an end of the leg of the tensioning bar such that turning or inserting the threaded rod causes the tensioning bar to move axially along the length of the elongated bore, forcing the first and second mounting means relatively apart and thereby increasing the tension therebetween.

In further accordance with the present invention, as the tension between the first and second mounting means approaches a desired level, the operator manually manipulating the tensioning means experiences resistance to further turning of the threaded rod. As the rod is further turned, the end of the hand table remote from the main table moves slightly upward, giving a visual indication that the tension between the first and second mounting means is at an acceptable level.

The hand table assembly in accordance with the present invention provides a stable hand table which is vertically adjustable to allow desirable positioning of the hand table relative to the main table surface. The hand table assembly also provides visual feedback or indication to the installer when the tension between the mounting means has reached a level corresponding to proper mounting of the hand table assembly to the main table.

BRIEF DESCRIPTION OF THE DRAWINGS

These and further features of the present invention will be apparent with reference to the attached drawing figures, wherein.

DETAILED DESCRIPTION OF THE PREFERRED EMBODIMENT

Figure 1:
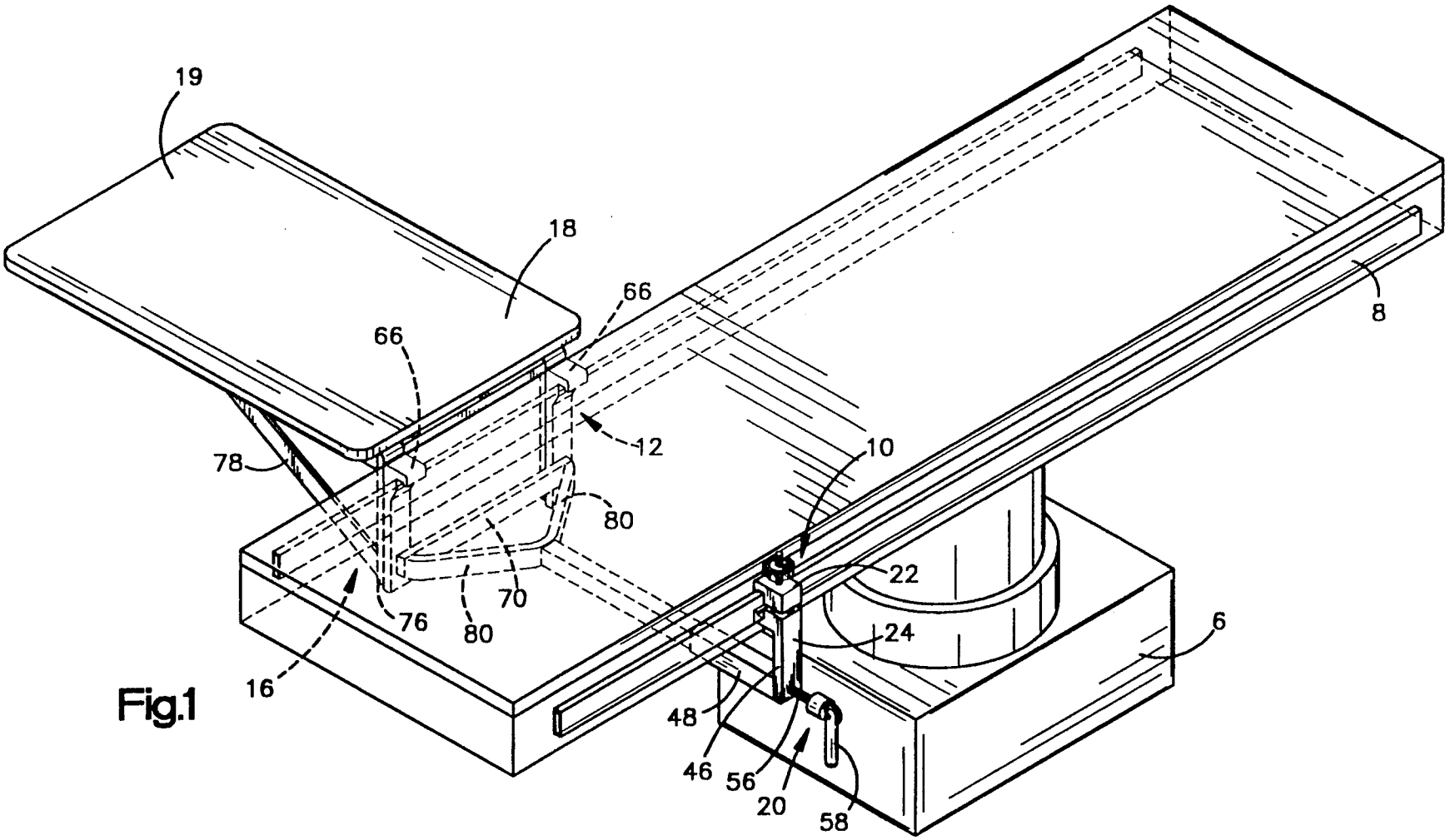
FIG. 1 is a perspective view of a surgical table with a hand table assembly according to the present invention mounted thereon.
Figure 2:
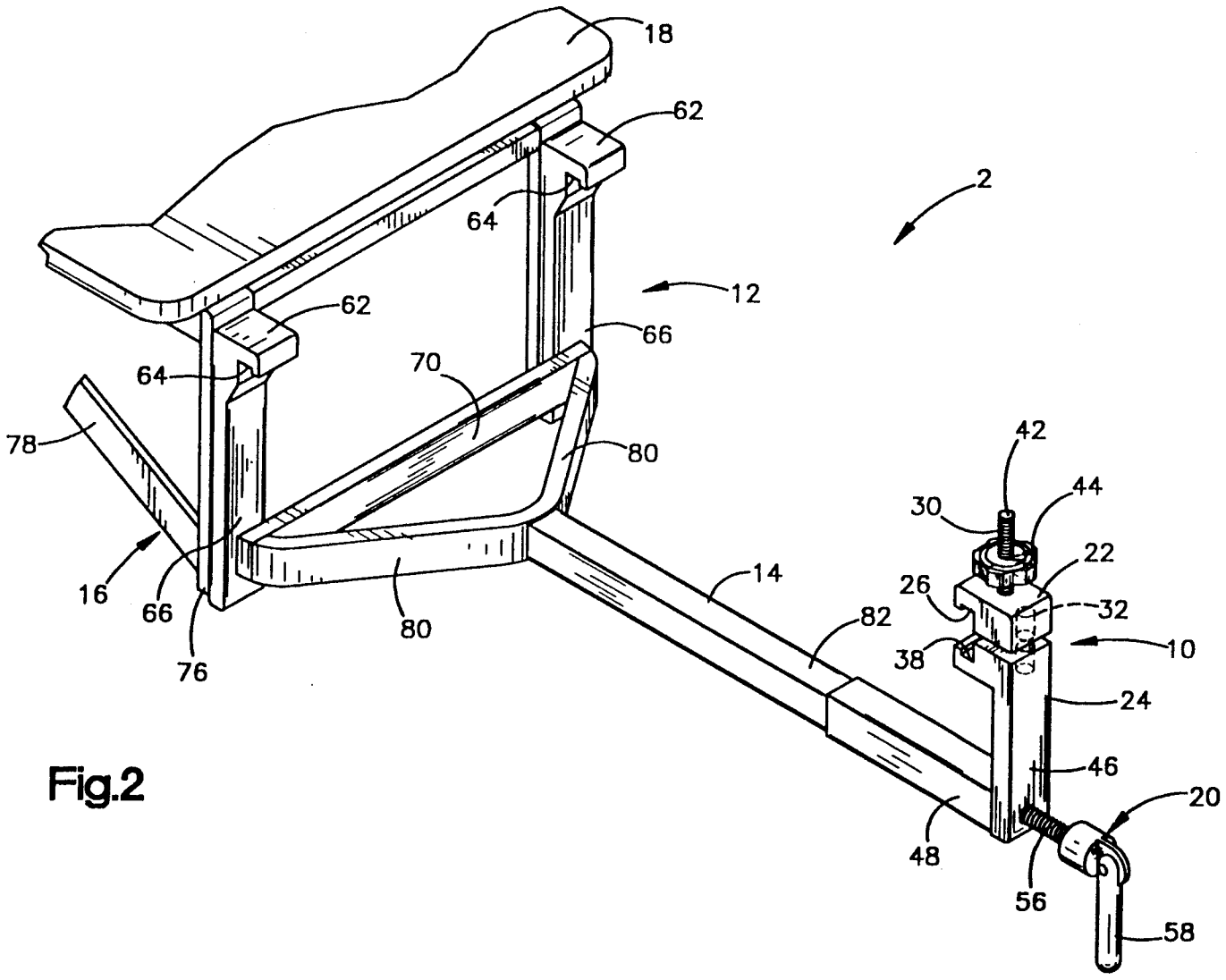
FIG. 2 is a perspective view of the hand table assembly of FIG. 1 according to the present invention.
Figure 3:
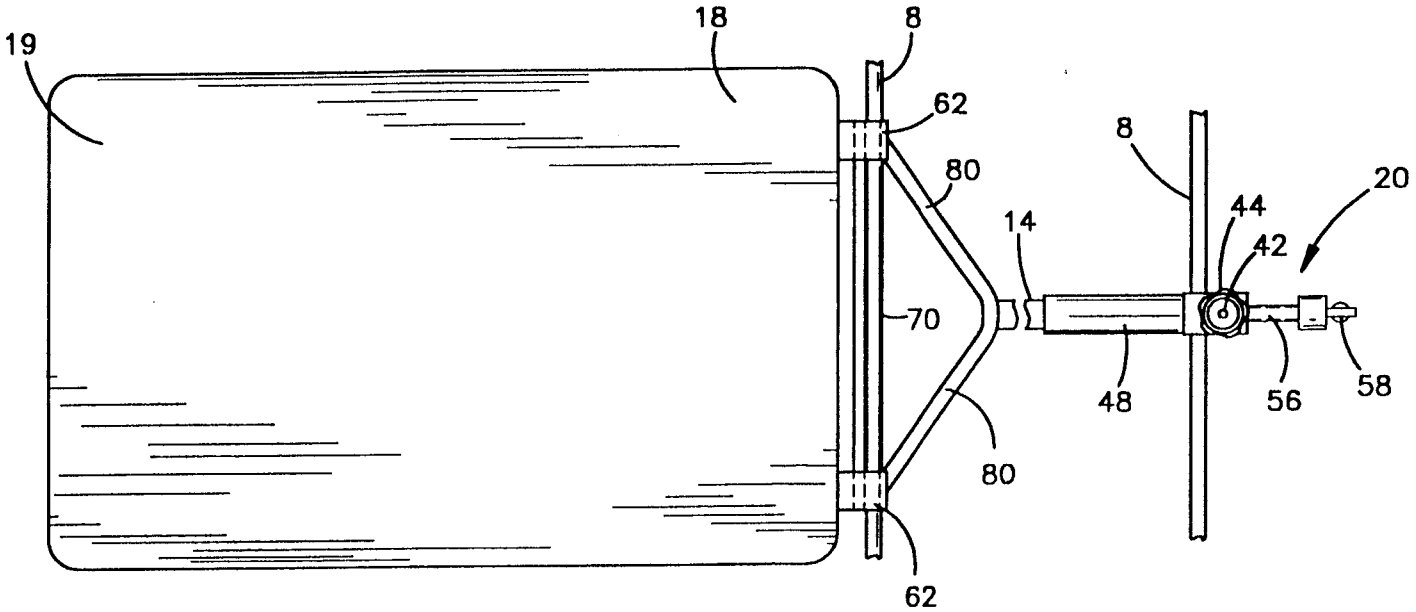
FIG. 3 is a top plan view of the hand table assembly according to the present invention.
Figure 4:
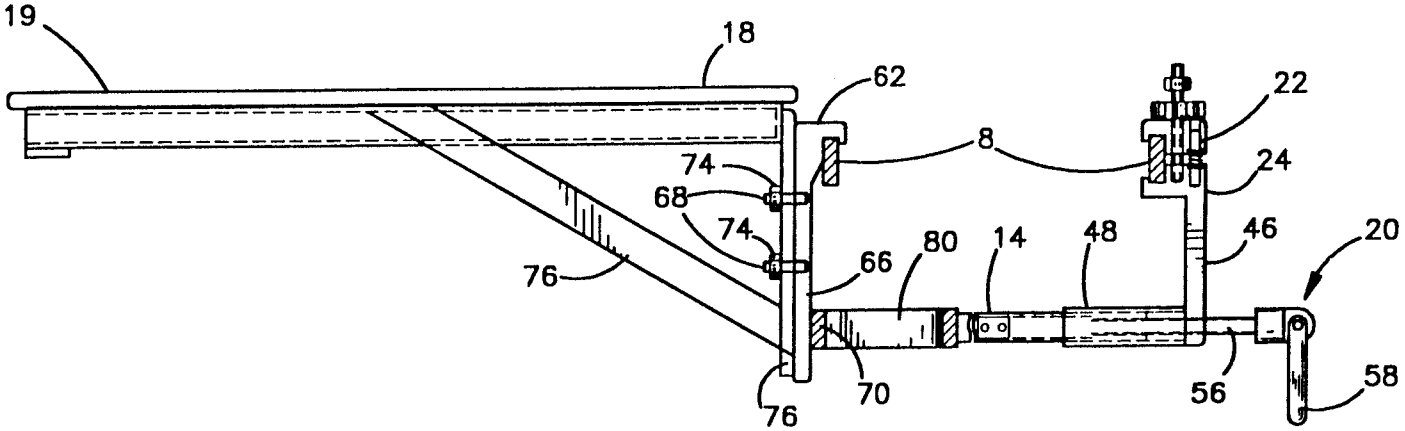
FIG. 4 is a front elevational view of the hand table assembly according to the present invention; and, FIG. 5 is a fragmentary front elevational view, in cross-section, in accordance with the present invention.

With reference to the drawing figures and, in particular, FIGS. 1 and 2, the hand table assembly 2 according to the present invention is shown mounted to a conventional main surgical table 4. The main surgical table is supported by a pedestal-type base 6 and has a pair of rails 8 to which is typically mounted accessory equipment or, in this case, the hand table assembly 2.

With reference to FIGS. 2–5, the hand table assembly 2 of the present invention is shown. The hand table assembly includes first and second mounting means 10, 12, a tensioning bar 14, a support means 16, a hand table 18, and a force or tension adjustment means 20. The hand table 18 is mounted to the rails 8 by the support means 16 and the first and second mounting means 10, 12, as will be described more fully hereafter.

Figure 5:
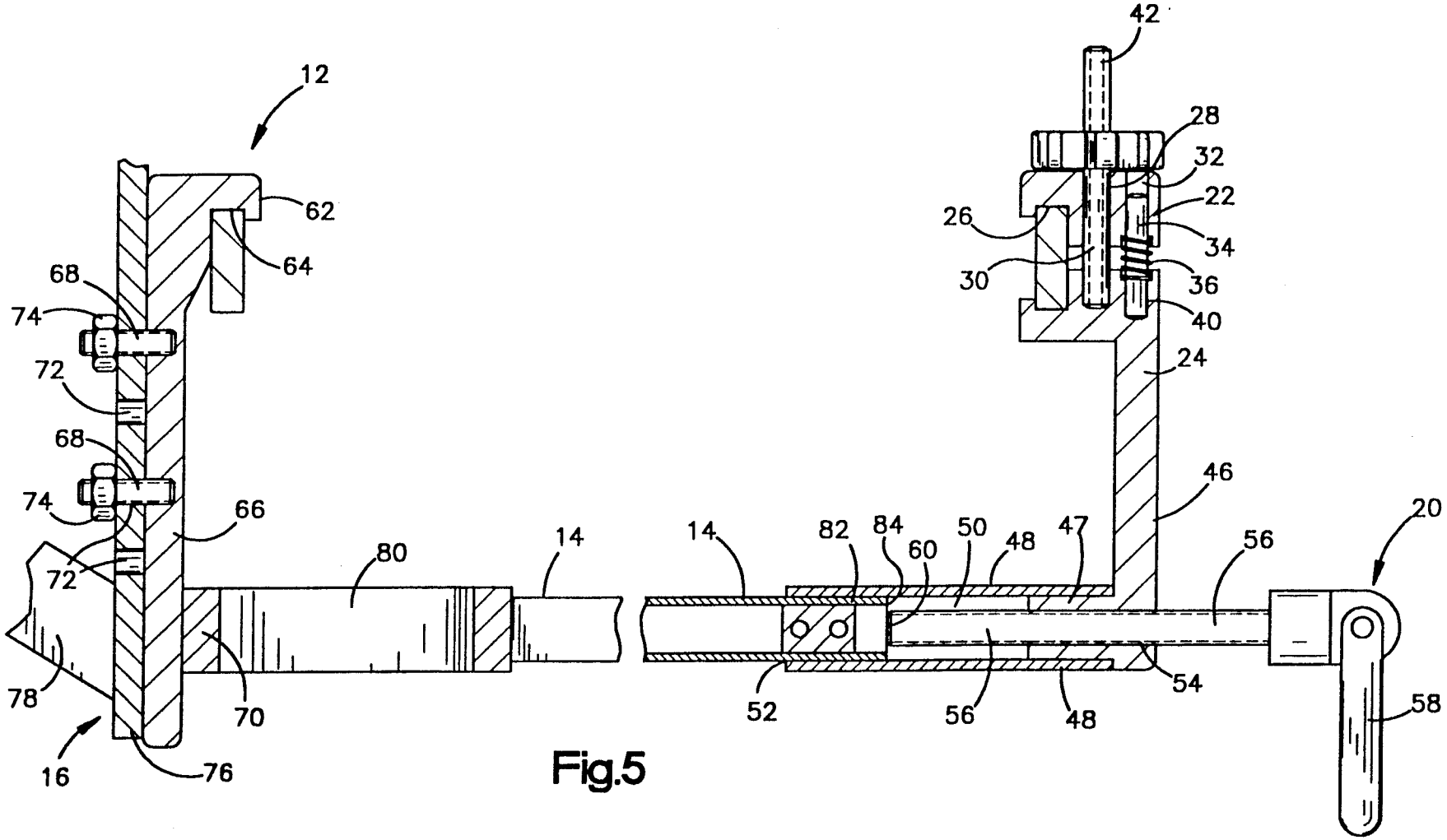

As shown best in FIGS. 2 and 5, the first mounting means 10 comprises top and bottom clamping jaw members 22, 24. The top jaw member 22 provides a downwardly opening channel 26 for receipt of the rail 8, a first bore 28 for slidably receiving a threaded stud 30, and a second bore 32 for housing an end portion of a shaft 34. The second bore 32 is countersunk a small amount to receive an end of a compression spring 36 which is positioned on the shaft 34 intermediate the top and bottom jaw members 22, 24, as illustrated.

The bottom jaw member 24 has extending upwardly therefrom the threaded stud 30, and also provides an upwardly opening channel 38 for receipt of the rail 8 and a bore 40 for receipt of the opposite end of the shaft 34, the bore 40 being countersunk to receive an end of the compression spring 36. Preferably, the threaded stud 30 and the shaft 34 are permanently attached to the bottom jaw member 24 by conventional adhesives or the like.

The upper terminal portion 42 of the threaded stud 30 is provided with a handle 44 which is used to adjust the position of the top jaw member 22 relative to the bottom jaw member 24 and, in so doing, firmly mounting the first mounting means 10 to the rail 8. The compression spring 36 tends to force the top and bottom clamping jaw members 22, 24 away from each other, and thereby aids in separating the jaw members when disengagement of the mounting means 10 from the rail 8 is desired.

The bottom jaw member 24 also provides a downwardly extending portion 46 which has an inwardly extending member 48 integral therewith. The inwardly extending member 48 is generally square in cross-section, having an outer terminal end 52 and a longitudinal, square-shaped bore 50 extending the length thereof. The downwardly extending portion 46 also includes an inwardly projecting member 47 which is received by the square shaped bore 50 of the inwardly extending member 48, extending into the bore 50 a short distance, as illustrated. A threaded bore 54 is provided by the downwardly extending portion 46 and the inwardly projecting member 47, and is generally coaxial with the square-shaped bore 50 provided by the inwardly extending member 48, as illustrated.

The threaded bore 54 is adapted to receive the force or tension adjustment means 20 to apply tension between the first and second mounting means 10, 12. As illustrated, the tension adjustment means 20 includes a threaded rod 56 which has a handle 58 associated therewith to ease the manual adjustment of the tension between the first and second mounting means 10, 12. The terminal end 60 of the threaded rod 56 is used to engage and axially move the tensioning bar 14 received within the square-shaped bore 50, as will be described hereafter.

The second mounting means 12 includes a pair of hook-shaped members 62, each having a downwardly opening channel 64 which fits over the rail 8 to mount the second mounting means 12 thereon. The hook-shaped members 62 also have downwardly extending portions 66, each of which further have a pair of threaded studs 68 extending outwardly therefrom. Preferably, the threaded studs 68 are permanently attached by adhesives or the like to the downwardly extending portions 66 of the hook-shaped members 62.

The hook-shaped members 62 are interconnected by a brace 70 which runs between the downwardly extending portions 66 thereof to help stabilize and unify the hook-shaped members 62. Preferably, the brace 70 is attached by welding, fasteners, or the like to the downwardly extending portions 66 of the hook-shaped members 62.

It should be clear that the first and second mounting means 10, 12 of the present invention can be formed in several equivalent manners, the specifically described mounting means being disclosed because they are the preferred embodiment of the invention presently contemplated by the inventor. For example, the hook-shaped members 62 of the second mounting means 12 do not have to be interconnected by the brace 70. Naturally, the hook-shaped members 62 of the mounting means 12 could be replaced by a clamp-type mounting means along the lines of that illustrated in the first mounting means 10, or any other known mounting device, without departing from the scope and spirit of the present invention.

The support means 16 is integrally formed with the hand table 18, and includes a downwardly extending member 76 and a brace 78. As illustrated, the downwardly extending member 76 extends from the end of the hand table 18 adjacent the main table while the brace 78 interconnects the hand table 18 and downwardly extending member 76 of the support means 16 at a location remote from their union, near the remote end 19 of the hand table 18. The brace 78 provides vertical support for the hand table 18.

The threaded studs 68 of the second mounting means 12 are vertically spaced apart a distance corresponding to the distance between paired mounting holes 72 provided by the downwardly extending member 76 of the hand table support means 16. The support means 16 is mounted on the studs 68 by inserting the studs 68 through the holes 78 and fastened in place by conventional fastening means 74. The vertical position of the hand table 18 relative to the main table 4 is adjusted by inserting the threaded studs 68 into paired holes 72 which are vertically displaced from the prior pair of holes, as is clear from the drawing figures and well known in the art. As illustrated, the holes 72 are spaced apart a distance equal to one-half the distance between the threaded studs 68 to provide incremental mounting positions, the increments of vertical adjustment being equal to one-half the distance between the studs.

The downwardly extending portion 66 of each of the pair of hook-shaped members 62 of the second mounting means 12 is also attached to a tensioning bar 14 via the brace 70. The tensioning bar 14 is generally Y-shaped, having each of its arms 80 welded or otherwise permanently attached to one end of the brace 70, as illustrated. Optionally, each of the arms 80 can directly attach to one of the hook-shaped members 62 and the brace 70 can be removed.

The leg 82 of the tensioning bar 14 is received by the square-shaped bore 50 provided by the inwardly extending member 48. The terminal end 84 of the leg 82 provides a bearing surface against which the terminal end 60 of the threaded rod 56 bears, thereby applying tension between the first and second mounting means 10, 12, as will be described hereafter.

Prior to mounting the hand table assembly 2 to the main surgical table 4 it is normally desirable to adjust the height of the hand table 18 in relation to the main surgical table 4. This is done by positioning the tensioning bar 14 under the main table, and hooking the second mounting means 12 over the rail. The support means 16 is mounted to the second mounting means 12 by inserting the outwardly extending threaded studs 68 provided by the second mounting means 12 into the paired holes 72 in the support means 16 at the location corresponding to the desired height of the hand table 18. After noting the location of the holes 72, the support means 16 is withdrawn or removed from the mounting studs 68, and the interconnected hook-shaped members 62 of the second mounting means 12 unhooked from the rail 8.

Thereafter, the previously-noted holes provided by the support means 16 are replaced over the mounting studs 68 and attached thereto by the fastening means 74. Naturally, this particular method of preliminary assembly is not necessary, the hand table assembly being capable of assembly in several equivalent manners, this method of assembly merely being the preferred method of assembly presently contemplated by applicant to preliminarily assemble the second mounting means and the hand table.

With the second mounting means 12 and the hand table 18 so assembled, mounting of the hand table assembly 2 to the main table 4 can begin. Initially, the tensioning bar 14 is placed under the main table and the second mounting means 12 is hooked over the rail 8 at the location along the length of the main table desired for placement of the hand table 18. With the second mounting means 12 mounted on one rail 8 and the tension bar extending towards the opposite side of the table, attachment of the first mounting means 10 thereto can occur.

Initially, the first mounting means 10 is prepared for placement on the rail 8 by loosening the handle 44 until the top and bottom clamping jaw members 22, 24 separate a distance sufficient to allow insertion of the rail 8 therebetween. With the first mounting means 10 so prepared, the terminal end 84 of the leg 82 of the tensioning bar 14 is inserted into the square-shaped bore 50 provided in the inwardly extending member 48. Thereafter, the first mounting means 10 is pushed towards the rail 8, allowing the top and bottom jaw members 22, 24 to encompass the rail while simultaneously sliding the leg 82 of the tensioning bar 14 further into the square-shaped bore 50. When the upwardly and downwardly opening channels 38, 26 provided by the bottom and top jaw members 24, 22, respectively, are properly positioned with respect to the rail 8, the handle 44 can be used to engage the jaw members 22, 24 with the rail and thereby firmly secure the first mounting means 10 to the rail 8.

To tension the hand table assembly 2, the threaded mounted rod 56 is turned, via the handle 58, such that the terminal end 60 of the rod engages the bearing surface provided on the terminal end 84 of the leg 82 of the bar 14. As the rod 56 is turned and thereby inserted into the threaded bore 54, the leg 82 moves axially along the length of the inwardly extending member 48, toward the second mounting means 12, thereby forcing the first and second mounting means 10, 12 relatively away from each other and tensioning the hand table assembly 2.

As the rod 56 is further turned by the installer, resistance is felt, indicating that the assembly is being firmly mounted to the main table 4. Additional turning of the threaded rod 56 will result in the remote end 19 of the hand table 18 moving upward relative to the main table, possibly surpassing the horizontal. Movement of the remote end 19 provides visual indication that the tension between the first and second mounting means 10, 12 is at the desired level and that the hand table assembly is properly mounted to the main table. As so mounted, the hand table 18 will be generally horizontal, although the remote end 19 being slightly above or below the rest of the table does not detract from its utility and desirability.

To remove the hand table assembly 2 from the rail 8, the threaded rod 56 and the handle 44 associated with the first mounting means 10 are loosened and then the first mounting means 10 is pulled off the rail 8. As the first mounting means 10 is moved away from the rail 8, the leg 82 of the tensioning bar 14 slides out of the square-shaped bore 50 provided by the inwardly extending member 48. Once the tensioning bar 82 is free from the inwardly extending member 48, the second mounting means 12 and hand table 18 are removed from the rail 8 by merely lifting the hook-shaped member 62 off the rail. Conveniently, the first mounting means 10 can attach to the Y-shaped bar 14 for storage.

The foregoing description was provided to illustrate the preferred embodiment of the present invention as currently contemplated by the inventor, and is not to be construed in a limitative manner. Rather, it is clear that the present invention is capable of being practiced in several equivalent manners, the true scope of the invention being only defined by the appended claims. The intersection and engagement of the tensioning bar and the first mounting means could be embodied by any number of means to provide tension and compressive forces in the first and second mounting means. For example, it is possible to provide means to attach the tensioning bar to the threaded rod such that there is compression between the first and second mounting means, rather than tension, and be within the scope of the present invention. Specifically, the tensioning bar could be provided with internal or external threads to engage the force adjustment means to alternatively provide tension or compression force between the first and second mounting means.

What is claimed is:

1. An auxiliary hand table, comprising:

first and second mounting means for releasably mounting said hand table to first and second rails provided by a surgical table, said first mounting means providing a force adjustment means; and, a bar extending between said first and second mounting means, said force adjustment means being in contact with said bar whereby adjustment of said force adjustment means increases the force between said first and second mounting means and more firmly mounts said hand table to said main table, said bar cooperating with said first and second mounting means to maintain said hand table in a generally horizontal position.

2. A hand table assembly according to claim 1, wherein said first mounting means includes clamping jaw members which releasably engage said first rail and fastening means to attach said first mounting means to said first rail.

3. A hand table assembly according to claim 2, wherein said second mounting means comprises a plurality of mounting brackets, each of said mounting brackets having a hook-shaped upper portion which engages said second rail to mount the second mounting means thereon, said mounting brackets being spaced along the length of the second rail to provide lateral stability for said hand table.

4. A hand table assembly according to claim 3, further comprising a hand table support means, said support means being integral with said hand table and releasably attached to said second mounting means by fastening means, said support means being vertically adjustable relative to said second mounting means to alter the vertical position of the hand table relative to the surgical table.

5. A hand table according to claim 1, wherein said force adjustment means is threadably mounted to said first mounting means and has a terminal end which is in contact with said bar.

6. A hand table according to claim 4, wherein said force adjustment means is threadably mounted to said first mounting means and has a terminal end which is in contact with said bar.

7. A hand table according to claim 6, wherein said bar is generally Y-shaped, arms of said bar being attached to said second mounting means while a leg thereof engages said first mounting means, said terminal end of said force adjustment means engaging a terminal end of said leg to apply force between said first and second mounting means.

8. A hand table according to claim 7, wherein the leg of said bar is received by a square-shaped bore provided by an inwardly extending portion of said first mounting means, said force adjustment means including a threaded rod which is received by a threaded bore provided by said first mounting means, said square-shaped bore and said threaded bore being generally coaxial, whereby rotation of said threaded rod inserts said threaded rod into said square-shaped bore.

9. An auxiliary hand table, comprising:

first and second mounting means for releasably mounting said hand table to first and second rails provided by a surgical table, said first mounting means providing a tension adjustment means; and, a tensioning bar extending between said first and second mounting means, said tension adjustment means being in contact with said tensioning bar whereby adjustment of said tension adjustment means moves said tensioning bar relatively away from said first mounting means and relatively towards the second mounting means and thereby increases the tension between said first and second mounting means and more firmly mounts said hand table to said main table, said bar cooperating with said first and second mounting means to maintain said hand table in a generally horizontal position.

10. A hand table assembly according to claim 9, wherein said first mounting means includes clamping jaw members which releasably engage said first rail and fastening means to attach said first mounting means to said first rail.

11. A hand table assembly according to claim 10, wherein said second mounting means comprises a plurality of mounting brackets, each of said mounting brackets having a hook-shaped upper portion which engages said second rail to mount the second mounting means thereon, said mounting brackets being spaced along the length of the second rail to provide lateral stability for said hand table.

12. A hand table assembly according to claim 11, further comprising a hand table support means, said support means being integral with said hand table and releasably attached to said second mounting means by fastening means, said support means being vertically adjustable relative to said second mounting means to alter the vertical position of the hand table relative to the surgical table.

13. A hand table according to claim 12, wherein said tension adjustment means is threadably mounted to said first mounting means and has a terminal end which contacts said tensioning bar.

14. A hand table according to claim 13, wherein said tensioning bar is generally Y-shaped, arms of said bar being attached to said second mounting means while a leg thereof engages said first mounting means, said terminal end of said tension adjustment means engaging a terminal end of said leg to apply tension between said first and second mounting means.

15. A hand table according to claim 14, wherein the leg of said tensioning bar is received by a square-shaped bore provided by an inwardly extending portion of said first mounting means, said tension adjustment means including a threaded rod which is received by a threaded bore provided by said first mounting means, said square-shaped bore and said threaded bore being generally coaxial, whereby rotation of said threaded rod inserts said threaded rod into said square-shaped bore.

16. A hand table according to claim 9, wherein said tension adjustment means is threadably mounted to said first mounting means and has a terminal end which contacts said tensioning bar.

17. An auxiliary hand table, comprising:

first and second mounting means for releasably mounting said hand table to first and second rails provided by a surgical table, said first mounting means including a generally hook shaped member which releasably engages said first rail and fastening means to attach said first mounting means to said first rail, said second mounting means comprising a pair of mounting brackets each having a hook-shaped upper portion which engages said second rail to mount the second mounting means thereon, said pair of hook-shaped brackets being spaced along the length of the second rail to provide lateral stability for said hand table;

a hand table support means, said support means being integral with said hand table and being releasably attached to said second mounting means by fastening means to vertically support said hand table, said support means being vertically adjustable relative to said second mounting means to alter the vertical position of the hand table relative to the surgical table; and, a tensioning bar, said tensioning bar being generally Y-shaped and extending between said first and second mounting means, a leg of said Y-shaped tensioning bar being received by an aperture formed in said first mounting means while arms thereof are attached to said second mounting means, said first mounting means further providing a tension adjusting means, said tension adjusting means being threadably mounted within said first mounting means and having a terminal end which is in contact with a terminal end of said leg, whereby adjustment of said tension adjustment means moves said leg towards said second mounting means and thereby increasing the tension between said first and second mounting means and more firmly mounting said hand table to said main table.

* * * * *